US006386723B1

(12) United States Patent
Eberlein et al.

(10) Patent No.: US 6,386,723 B1
(45) Date of Patent: May 14, 2002

(54) TASKLIGHT FOR WORKSPACES AND THE LIKE

(75) Inventors: David C. Eberlein, Hudsonville; Douglas D. Buyce, Kentwood; Terry L. Lautzenheiser, Grand Haven; Michael W. Welsh, Rockford; Jonathan J. King, East Grand Rapids; Michael C. Andrusiak, Middleville; Royal A. Kent, Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/257,410

(22) Filed: Feb. 25, 1999

(51) Int. Cl.[7] ..... G09F 13/00

(52) U.S. Cl. ..... 362/33; 362/217; 362/97; 362/127; 362/218; 362/224; 362/264; 362/225; 362/345

(58) Field of Search ..... 362/33, 127, 217, 362/223, 225, 218, 222, 97, 133, 345, 224, 264, 294, 373, 370

(56) References Cited

U.S. PATENT DOCUMENTS

| | | | |
|---|---|---|---|
| 1,902,860 | A | 3/1933 | Kay et al. |
| 3,160,350 | A | 12/1964 | Rex et al. |
| 3,389,246 | A | 6/1968 | Shemitz |
| 3,679,893 | A | 7/1972 | Shemitz et al. |
| 4,054,793 | A | 10/1977 | Shemitz |
| 4,071,750 | A | 1/1978 | Schneppendahl et al. |
| 4,164,009 | A | 8/1979 | Maguire, Jr. et al. |
| 4,373,178 | A | 2/1983 | Gulliksen |
| 4,383,289 | A | 5/1983 | Lewin |
| 4,390,930 | A | 6/1983 | Herst et al. |
| 4,432,044 | A | 2/1984 | Lautzenheiser |
| 4,434,453 | A | 2/1984 | Campbell |
| 4,450,509 | A | 5/1984 | Henry |
| 4,519,019 | A | 5/1985 | Hall |
| 4,536,830 | A | 8/1985 | Wisniewski |
| 4,542,449 | A | 9/1985 | Whitehead |
| 4,562,515 | A | 12/1985 | Lautzenheiser |
| 4,599,684 | A | 7/1986 | Lee |
| 4,616,296 | A | 10/1986 | Westgaard et al. |
| 4,617,612 | A | 10/1986 | Pritchett |
| 4,729,075 | A | 3/1988 | Brass |
| 4,748,543 | A | 5/1988 | Swarens |
| 4,751,626 | A | 6/1988 | Plewman |
| 4,779,178 | A | 10/1988 | Spitz |

(List continued on next page.)

OTHER PUBLICATIONS

Exhibit A is an article entitled "Knoll Project Profile", date unknown, but at least as early as Feb. 24, 1998.

Exhibit B is a "Garcy Panel Mount Task Light", Garcy Systems Lighting Products, date unknown, but at least as early as Feb. 24, 1998.

*Primary Examiner*—Sandra O'Shea
*Assistant Examiner*—Anabel Ton
(74) *Attorney, Agent, or Firm*—Price, Heneveld, Cooper, DeWitt & Litton

(57) ABSTRACT

A tasklight includes a first elongated cover portion defining a first elongated side edge. A second elongated cover portion is connected to the first cover portion, and defines therewith a housing having a lower side. The second elongated cover portion defines a second elongated side edge, and the second side edge is spaced-apart from the first side edge to define an open space between the first and second side edges that extends along a rear side of said housing. An elongated light source is positioned proximate the lower side of the housing. A reflective surface on the lower side of the housing has a shape configured to distribute light produced by the light source forwardly onto the worksurface. The reflective surface forms a passageway with the open space of the housing, and permits heat produced by the light source to escape through the open space of the housing by convection.

48 Claims, 14 Drawing Sheets

U.S. PATENT DOCUMENTS

| | | | | | |
|---|---|---|---|---|---|
| 4,791,540 | A | | 12/1988 | Dreyer, Jr. et al. | |
| 4,799,136 | A | | 1/1989 | Molnar | |
| D306,909 | S | | 3/1990 | Kelley et al. | |
| 4,939,627 | A | | 7/1990 | Herst et al. | |
| 5,036,436 | A | | 7/1991 | Rattigan et al. | |
| 5,040,104 | A | | 8/1991 | Huisingh et al. | |
| 5,079,680 | A | | 1/1992 | Kohn | |
| 5,079,683 | A | * | 1/1992 | McGuire | 362/293 |
| 5,094,174 | A | | 3/1992 | Grund et al. | |
| 5,115,380 | A | | 5/1992 | Huisingh et al. | |
| 5,205,632 | A | | 4/1993 | Crinion | |
| 5,349,505 | A | | 9/1994 | Poppenheimer | |
| D356,647 | S | | 3/1995 | Jung | |
| 5,440,467 | A | | 8/1995 | Lautzenheiser | |
| 5,452,875 | A | | 9/1995 | Kern | |
| 5,481,637 | A | | 1/1996 | Whitehead | |
| 5,483,428 | A | | 1/1996 | Poppenheimer | |
| 5,486,042 | A | | 1/1996 | Heisler et al. | |
| 5,486,990 | A | | 1/1996 | Sejkora | |
| 5,530,628 | A | | 6/1996 | Ngai | |
| 5,593,225 | A | * | 1/1997 | Safyan | 362/427 |
| 5,604,586 | A | | 2/1997 | Bähr et al. | |
| 5,746,502 | A | * | 5/1998 | Huang | 362/223 |
| 5,758,585 | A | * | 6/1998 | Latchinian | 108/23 |
| 5,839,240 | A | | 11/1998 | Elsholz et al. | |
| 5,842,775 | A | * | 12/1998 | Roorda et al. | 362/294 |
| 5,984,486 | A | * | 11/1999 | Munz et al. | 362/33 |
| 6,039,457 | A | * | 3/2000 | O'Neal | 362/217 |
| 6,076,308 | A | | 6/2000 | Lyon et al. | |
| 6,142,061 | A | * | 10/2000 | Andrus et al. | 362/217 |

* cited by examiner

TASKLIGHT FOR WORKSPACES AND THE LIKE

BACKGROUND OF THE INVENTION

The present invention relates to light assemblies, and in particular to a light assembly that provides well distributed light, and is mountable to a variety of workspaces.

Offices and the like are often furnished with workstation based furniture systems which include one or more worksurfaces, and further which include personalized lighting to provide adequate working light for performing tasks on the worksurfaces. Such workspaces are often bounded by a vertical rear panel having a vertical surface. In many furniture systems, the working light is provided by light fixtures mounted under overhead cabinets and shelves. The worksurfaces are located generally below the overhead cabinets and shelves, but also extend forward of the overhead cabinets and shelves. Thus, working light from the light fixtures must be projected forwardly to fully illuminate the worksurface. However, reflected light and/or unreflected light emitted from a linear light source such as a florescent light bulb tends to illuminate unevenly, such that there are annoying shades and uneven areas of light on the worksurface. Efforts to better disperse the light have resulted in light fixture designs including lenses which are costly to provide and assemble; which make bulb replacement cumbersome and difficult; and which detract from the asthetics of the light fixtures. Furthermore, worksurfaces have been developed which do not include overhead cabinets or shelves, such that a light fixture can not be readily mounted in a position over the worksurface. Thus, a light assembly solving the aforementioned problems is desired.

SUMMARY OF THE INVENTION

One aspect of the present invention is to provide a tasklight for illuminating a workspace having a horizontal worksurface and a vertical rear surface. The tasklight includes a first elongated cover portion defining a first elongated side edge. A second elongated cover portion is connected to the first cover portion, and defines therewith a housing having a lower side. The second elongated cover portion defines a second elongated side edge, and the second side edge is spaced-apart from the first side edge to define an open space between the first and second side edges that extends along a rear side of said housing. An elongated light source is positioned proximate the lower side of the housing. A reflective surface on the lower side of the housing has a shape configured to distribute light produced by the light source forwardly onto the worksurface. The reflective surface forms a passageway with the open space of the housing, and permits heat produced by the light source to escape through the open space of the housing by convection.

Another aspect of the present invention is a tasklight for illuminating a workspace having a horizontal worksurface and a vertical rear surface. The tasklight includes a first elongated cover portion defining a first elongated side edge. A second elongated cover portion is connected to the first cover portion, and defines therewith a housing having a lower side. The second elongated cover portion defines a second elongated side edge, and the second side edge is spaced-apart from the first side edge to define an open space between the first and second side edges. An elongated light source is positioned proximate the lower side of the housing. A reflective surface on the lower side of the housing has a shape configured to distribute light produced by the light source forwardly onto the worksurface. The reflective surface forms a passageway with the open space of the housing, and permits light produced by the light source to escape rearwardly onto the vertical rear surface through the open space of the housing.

Yet another aspect of the present invention is a tasklight for illuminating a worksurface, including an elongated housing having a lower side and an elongated tubular light source. A fixture mounts the elongated tubular light source below the housing, and an elongated refractor extends along the lower side of the housing. A refractor defines an upper side, and envelops at least a portion of the tubular light source and distributes light therefrom in a predetermined pattern. The upper side of the refractor has an open portion permitting transfer of heat away from the tubular light source.

Yet another aspect of the present invention is a light arrangement including a housing defining a first side. An elongated tubular light source defines an outer surface, and extends along the first side of the housing in a spaced-apart relationship thereto. An elongated refractor distributes light axially along the tubular light source in a predetermined pattern to reduce glare on a worksurface. The refractor is positioned around at least a portion of the light source, and includes a wall portion having a curved inner surface that is spaced-apart from the outer surface of the tubular light source to permit convective heat flow therefrom to facilitate cooling of the lighting arrangement.

Yet another aspect of the present invention is a kit for mounting a tasklight to various types of partition panels. The kit includes a tasklight having an elongated housing with a light fixed on the lower side thereof for mounting of an elongated light source below the housing. First and second brackets are adapted to be interconnected with the housing for support thereof. The first bracket has a first type connecting portion shaped to engage a first type of panel system and support the housing thereon. The second bracket has a second type connecting portion shaped to engage a second type of panel system and support the housing thereon. The tasklight can be quickly and easily mounted to first and second types of partition panels by selection of a first or second bracket corresponding to the first and second types of partition systems.

Yet another aspect of the present invention is a tasklight for mounting in a workspace of the type defined by a vertical surface forming a rear perimeter of the workspace and a forwardly projecting worksurface. The tasklight includes an elongated housing having a reflective surface on the lower side thereof for distributing reflected light from a light source. A lighting fixture is attached to the housing and positions an elongated light source adjacent the housing in general alignment therewith. A riser is connected with tie housing, and extends downwardly therefrom to support the housing above the worksurface at a height facilitating illumination of tasks performed on the worksurface. The riser includes a connector configured to securely interconnect the tasklight to a selected one of the worksurface and the vertical surface.

Yet another aspect of the present invention is a reflector for tasklights that is shaped to distribute light from an elongated light source in a predetermined pattern on a worksurface. The reflector defines a first generally parabolic surface extending forwardly from the elongated light source. The reflector also includes a generally flat portion extending forwardly portion of from the parabolic surface. The flat portion of the reflector is positioned to reduce the light intensity on a selected portion of the worksurface forward of the reflector.

These and other advantages of the invention will be further understood and appreciated by those skilled in the art by reference to the following written specification, claims, and appended drawings.

DETAILED DESCRIPTION OF PREFERRED EMBODIMENTS

Figure 1:
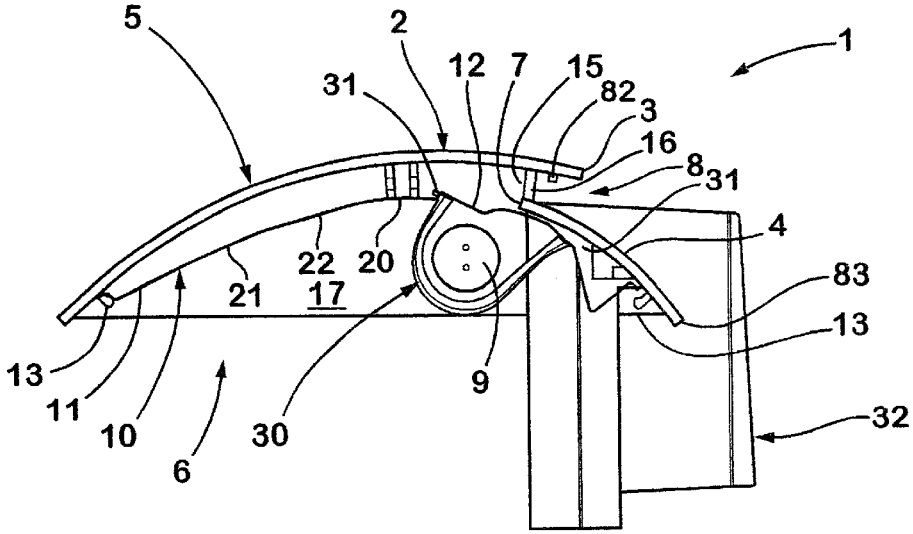
FIG. 1 is a side elevational view of a tasklight embodying the present invention, comprising a housing, reflector and refractor.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a tasklight embodying the present invention, which is particularly designed for use in open office plans, and other similar settings and environments. In the illustrated example, tasklight 1 includes a first elongated cover portion 2 defining a first elongated side edge 3. A second elongated cover portion 4 is connected to the first cover portion 2, and defines therewith a housing 5 having a lower side 6. The second elongated cover portion 4 defines a second elongated side edge 7. The second side edge 7 is a spaced-apart from the first side edge 3 to define an open space 8 between the first and second side edges 3, 7 respectively. An elongated light source, such as a florescent tube 9 is positioned approximate the lower side 6 of the housing 5. Florescent tube 9 is preferably a "T5" tube having a ⅝" diameter, such that the tasklight has a relatively low profile providing an unobtrusive appearance. A reflective surface 10 on the lower side 6 of housing 5 has a shape configured to distribute light produced by the florescent tube 9 forwardly onto a worksurface. Reflective surface 10 is formed on a reflector 11 having at least one aperture 12 therethrough forming a passageway with the open space 8 of the housing 5 and permitting heat and light produced by the florescent tube 9 to escape through the open space 8 of the housing 5.

Figure 2:
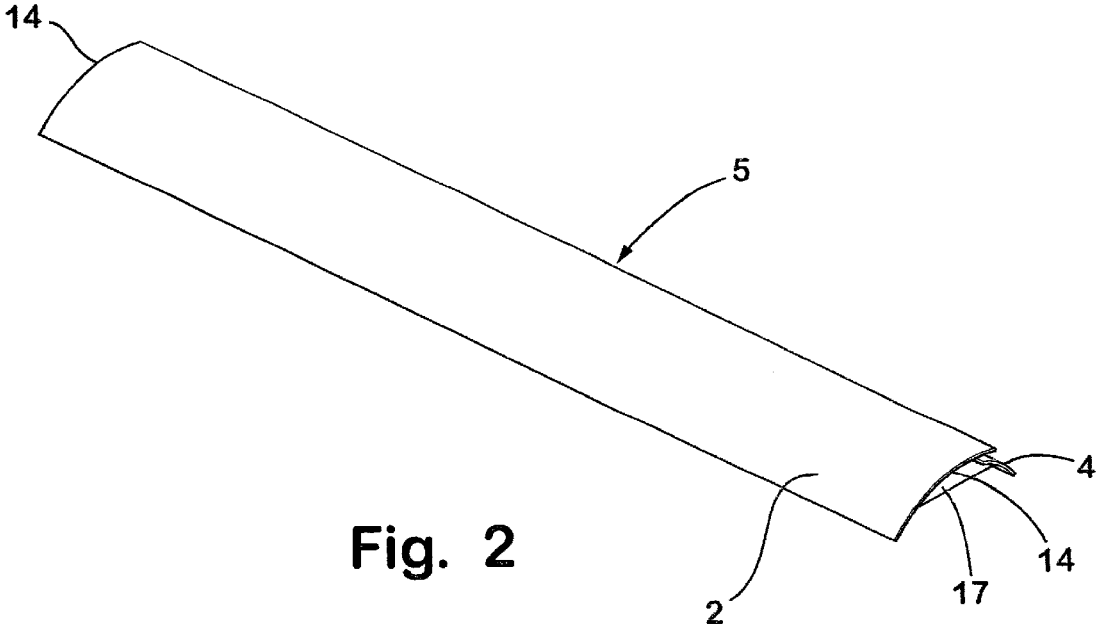
FIG. 2 is a perspective view of the tasklight housing.

With further reference to FIG. 2, housing 5 is a one-piece member formed from aluminum. First and second cover portions 2 and 4 each have a generally uniform cross-sectional shape, and are interconnected by a short vertical wall 15. Vertical wall 15 has a plurality of apertures 16 therethrough that permit heat to escape from the housing 5. The apertures 16 also permit light to escape rearwardly through an upper portion of the housing 5. As discussed in more detail below, this arrangement permits some of the light produced by the florescent tube 9 to be projected rearwardly onto a vertical rear surface of a workspace. The cover portions 2 and 4 each have a thickness of about 0.100 inches, and the first elongated cover portion 2 preferably has a radius of about 5.45 inches. Second cover portion 4 preferably has a radius of about 2.72 inches. Rear edge 3 of cover portion 2 extends over, and overlaps front edge 7 of cover portion 4. Housing 5 has a relatively small overall height dimension, providing an obtrusive appearance. A polymer end cap 17 is positioned inwardly of end 14 of housing 5, and closes off each end of housing 5.

Figure 3:
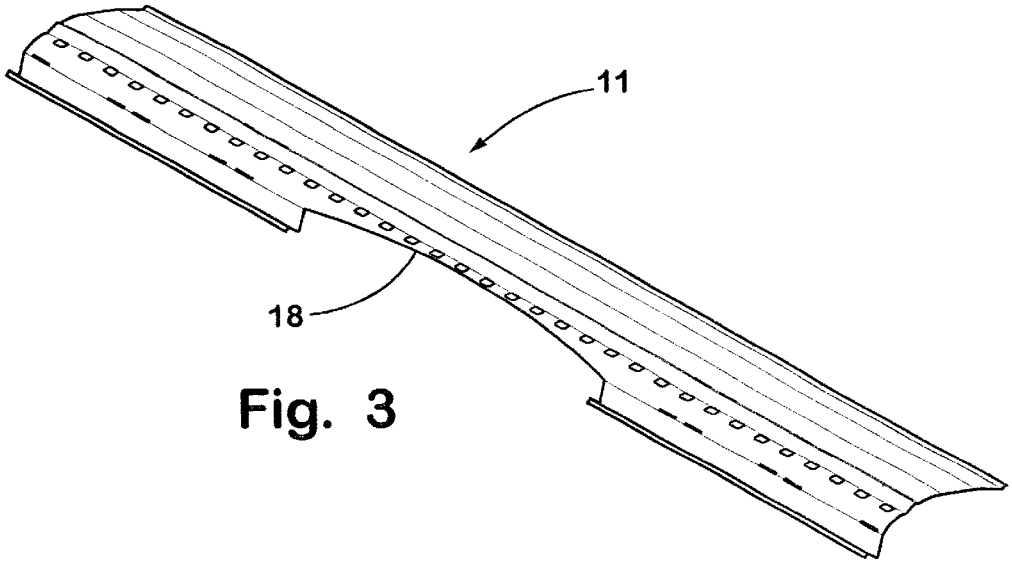
FIG. 3 is a perspective view of the reflector.
Figure 4:
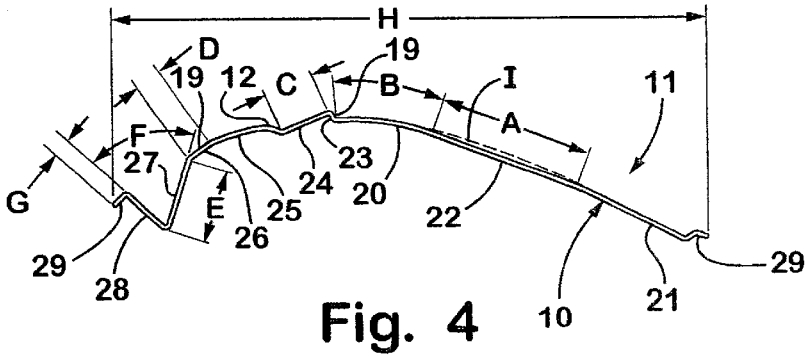
FIG. 4 is a side elevational view of the reflector.
Figure 5:
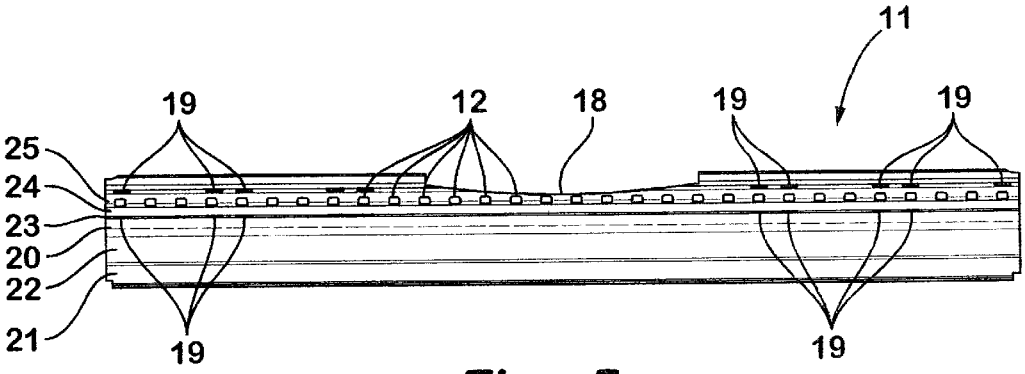
FIG. 5 is a bottom elevational view of the reflector.

With further reference to FIGS. 3–5, reflector 11 is made from specular aluminum having a material thickness of 0.025. Reflector 10 forms a reflective surface 10 having a first parabolic portion 20 and a second parabolic portion 21. A flat section 22 extends between the parabolic surfaces 20 and 21. Parabolic surfaces 20 and 21 form part of a paraboloidal surface having a single focal point and other parameters such that the paraboloidal surface would continue along the dotted line "I" if flat surface 22 were not present. As described in more detail below, the parabolic surfaces 20 and 21 project the light forwardly onto a horizontal worksurface below the tasklight 1. The flat surface 22 reduces the intensity of the light which would otherwise peak at a point 35 (FIG. 4A) at a horizontal distance of about 19 inches from the rear vertical worksurface. Dimension "A" (FIG. 4) is preferably about 1.330 inches, and dimension "B" is preferably about 0.903 inches. A small flat portion 23 includes openings 19 therethrough that receive connector tabs 31 of refractor 30 described in more detail below. A small flat portion 24 faces downwardly and forwardly, and has a dimension "C" of about 0.495 inches. Flat portion 24 projects light forwardly, and also disperses light in a manner that prevents "hot spots" having high light intensity in the distributed light pattern. The forwardly and downwardly facing adjacent curved part 25 also helps to reduce "hot spots", and also reflects light downwardly in a manner that prevents direct reflection of light from the florescent tube 9. A small flat portion 26 has a plurality of apertures 19 therethrough that receive connector tabs 31 of refractor 30. Flat portion 26 has a dimension "D" of about 0.251 inches. Flat portion 27 of the reflective surface 10 faces forwardly and downwardly, and also projects light forwardly and prevent "hot spots". Flat portion 27 has a dimension "E" of about 0.709 inches. Flat portion 28 provides flexibility, such that tabs 29 of the reflector 11 can be engaged with the protrusions 13 (see also FIG. 1) of housing 5 to mount reflector 11 to housing 5. Flat portions 27 and 28 form an angle "F" of about 64.5°, and the reflector 11 has an overall dimension "H" of about 5.541 inches. The shape of parabolic surfaces 20 and 21 is illustrated in FIG. 4B. With reference to FIG. 5, apertures 12 extend along the curved portion 25, and have a dimension of about 0.500 inches long by 0.300 inches wide. During use, light from light source 9 passes through apertures 12 and through opening 8 in housing 5, and projects rearwardly onto the vertical rear surface of a workspace. Apertures 12 and opening 8 also form a passageway that permits convective transfer of heat from light source 9 through reflector 11 and housing 5. As noted above, apertures 19 receive the connector tabs 31 of refractor 30, thereby retaining the refractor 30 to the reflector 11. The reflector 11 is cut-out at 18 to provide clearance for the ballast/control box 32 (FIG. 1).

Figure 4A:
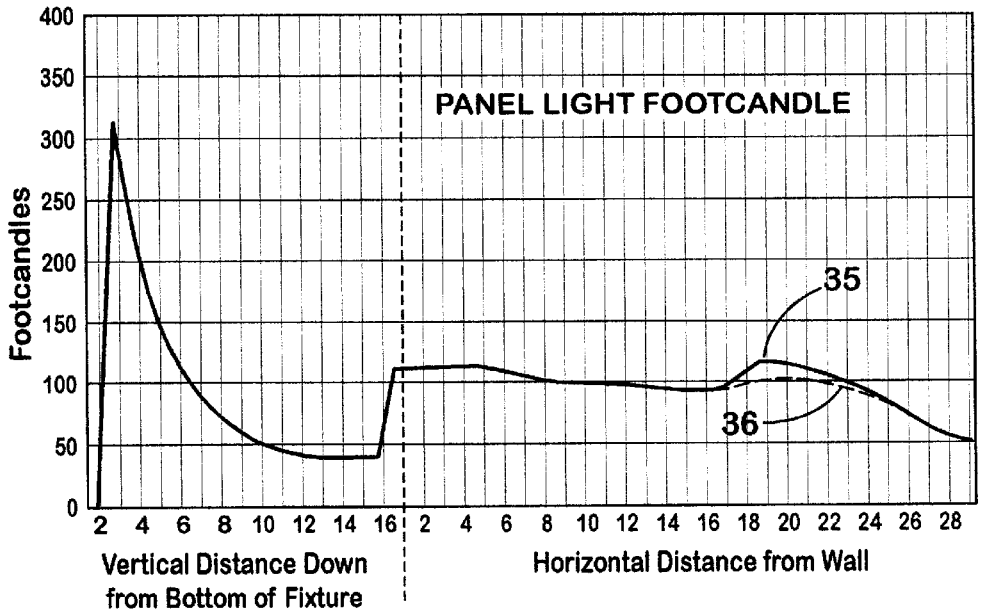
FIG. 4A is a graph of the light intensity from the tasklight on a horizontal worksurface and vertical rear surface of a workspace.
Figure 4B:
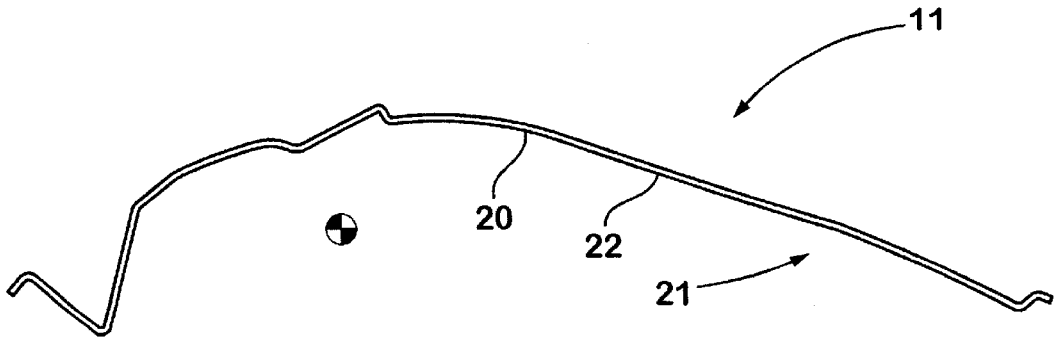
FIG. 4B is a side elevational view of the reflector showing the shape of the parabolic reflective surfaces.

Reflector 11 and refractor 30 illuminate the vertical and horizontal surfaces of a workspace as illustrated in FIG. 4A. If the flat reflective portion 22 is not present such that a single paraboloidal surface including surfaces 20 and 21 and extending along the line "I", reflector 11 forms a peak 35 in the illumination will occur about 19 inches out from the vertical surface. However, the flat surface 22 reduces the intensity of the peak 35, such that the light intensity follows a lower intensity line, approximately as illustrated by the dashed line 36. This arrangement provides a more even light distribution on the horizontal worksurface that reduces glare.

Figure 6:
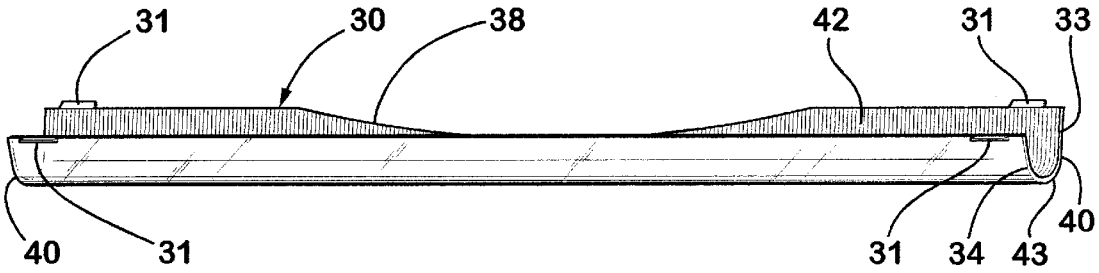
FIG. 6 is a perspective view of the refractor.
Figure 7:
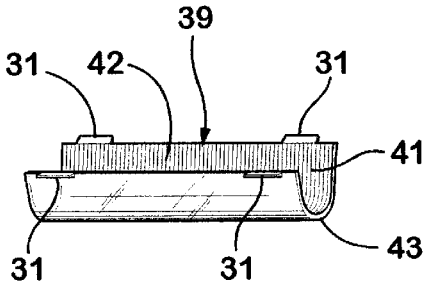
FIG. 7 is a perspective view of a refractor extension piece used with the refractor of FIG. 6 for longer tasklight configurations.
Figure 8:
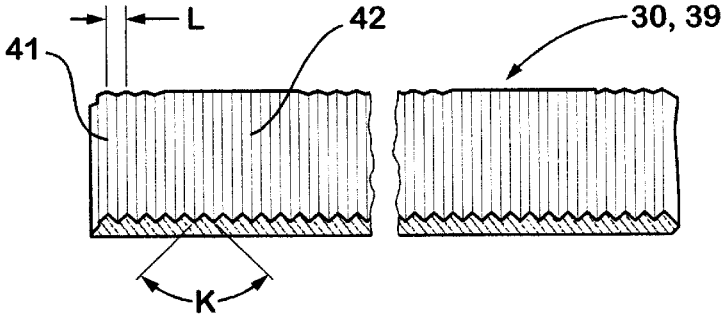
FIG. 8 is a fragmentary cross-sectional view of the refractors of FIGS. 6 and 7 illustrating the refractive prisms.

With further reference to FIGS. 6–8, refractor 30 has a generally U-shaped cross-section, and is made of an optical grade acrylic polymer. The U-shape defines first and second legs 33 and 34 that have sufficient flexibility to permit flexing of the refractor 30 during insertion of connector tabs 31 into apertures 19 of reflector 11. Refractor 30 is centered within the reflector 11, and includes a cut-out portion 38 to provide clearance for the ballast/control box 32. A shorter refractor 39 illustrated in FIG. 7 may be used for longer length tasklights 1, and is placed adjacent, and aligned with, the ends 40 of refractor 30. A plurality of optic prisms 41 are provided on the inner surface 42 of each refractor 30 and 39. The prisms 41 extend around the first and second legs 33 and 34, and also around a radiused portion 43. Prisms 41 form a 90° angle "K", and are spaced-apart about 0.096 inches. Refractors 30 and 39 distribute the light axially along the florescent tube 9, and thereby reduce glare by reducing the light intensity directly in front of the tasklight 1. With reference to FIG. 1, refractor 30 is sized to provide clearance around the outer surface of florescent tube 9 to facilitate airflow and convective heat transfer away from tube 9. The open upper side of refractor 30 allows heat to escape through the openings in reflector 11 and housing 5.

As illustrated in FIGS. 9–13, tasklight 1 may be mounted various types of workspaces 50. Each of the workspaces 50 of FIGS. 9–13 have a relatively low rear panel 51, such that the tasklight 1 cannot be mounted below an overhead storage bin or shelf. Each of the workspaces 50 is bounded by a vertical rear surface 52, and a horizontal worksurface 53.

Figure 9:
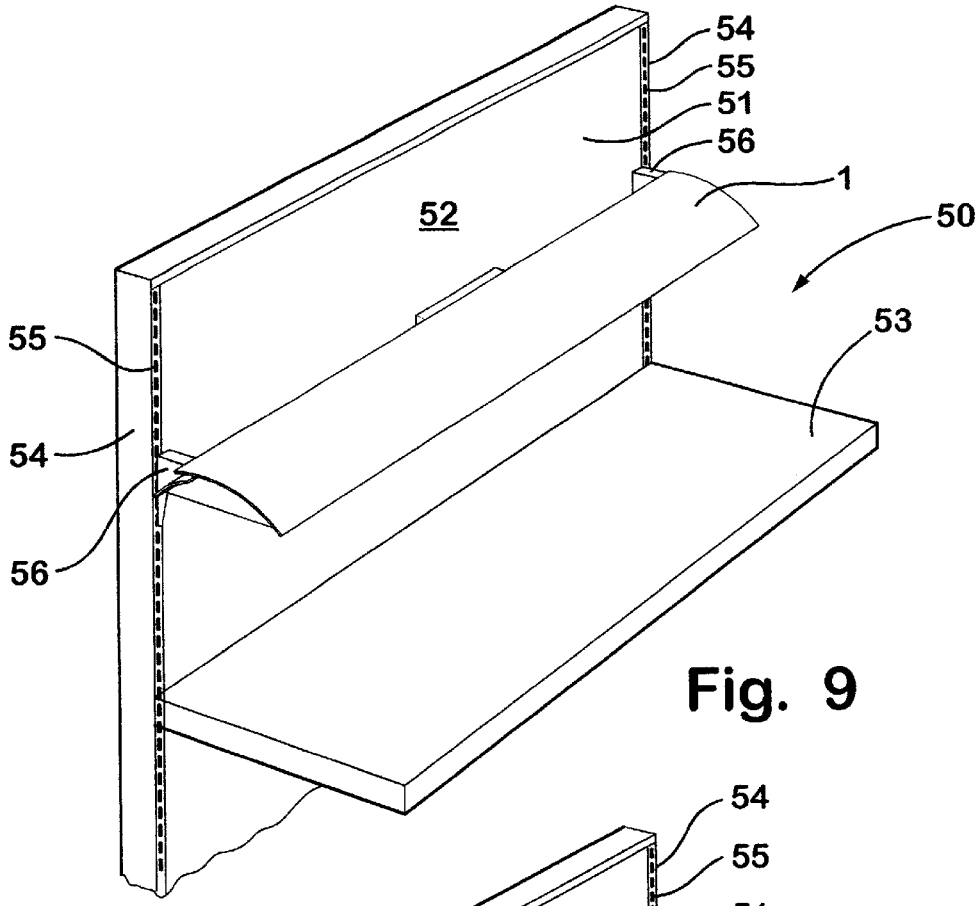
FIG. 9 is a partially schematic, fragmentary perspective view showing the tasklight mounted to the vertical slotted uprights of a partition panel system.

The rear panel 51 of FIG. 9 includes a pair of spaced-apart vertical frame members 54, each of which has a vertical row of apertures 55 for receiving hang-on accessory units such as worksurface 53. As described in more detail below, a pair of hooked brackets 56 are received in the apertures 55, and support the tasklight 1 above the worksurface 53. Each of the mounting arrangements illustrated in FIGS. 9–13 position the tasklight above the worksurface 53 at a height between about 14 inches to around 24 inches, with 18 inches off the worksurface 53 being preferred.

Figure 10:
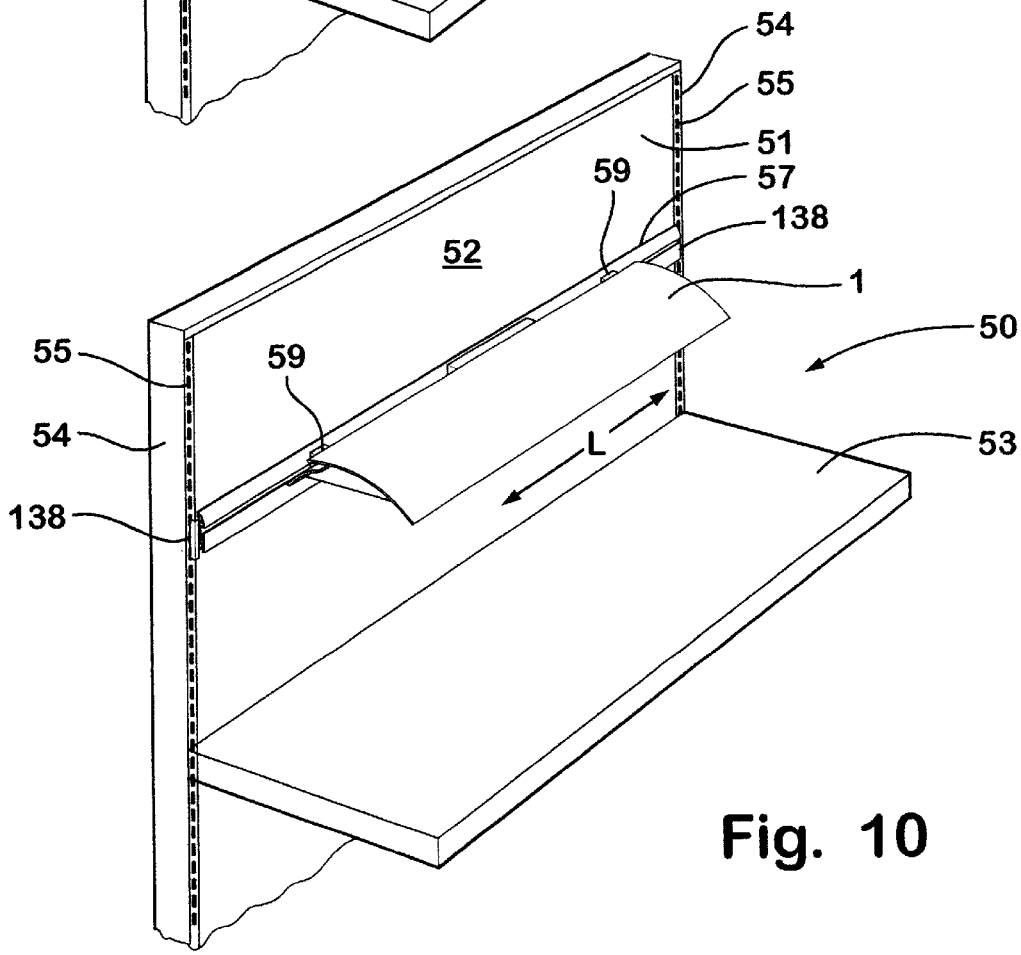
FIG. 10 is a partially schematic, fragmentary perspective view showing the tasklight mounted to a rail that is connected to the slotted vertical uprights of a partition system.

With reference to FIG. 10, another mounting arrangement includes an elongated horizontal rail 57 having hooked brackets 138 that are received in the apertures 55 of the vertical upright 54. A second pair of brackets 59 interconnect the tasklight 1 to the horizontal rail 57, and permit horizontal shifting of tasklight 1 in direction of the arrow "L".

Figure 11:
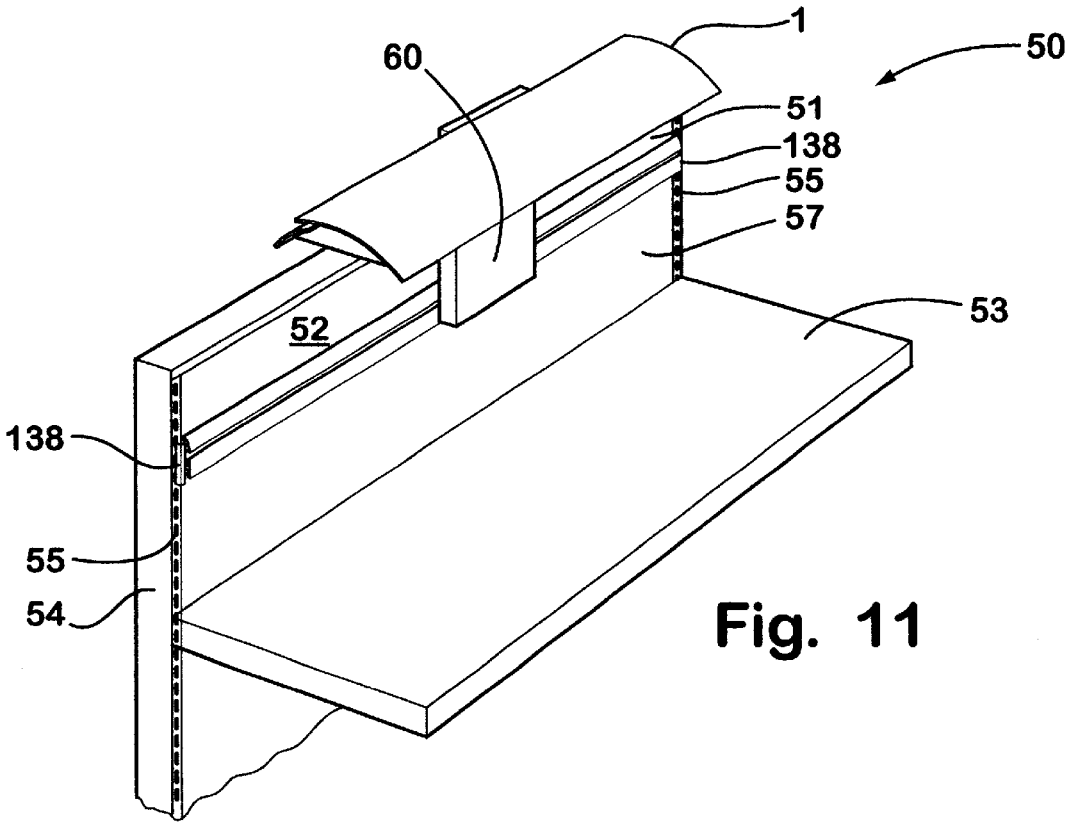
FIG. 11 is a partially schematic, fragmentary perspective view of the tasklight utilizing a riser mounted to a rail that is mounted to the slotted vertical uprights of a partition panel system.

With reference to FIG. 11, another version of the tasklight 1 is substantially similar to the arrangement illustrated in FIG. 10, except that a riser 60 is provided to position the tasklight 1 above the rail 57 in applications having a very low rear panel 51. Riser 60 includes a hooked lower portion (not shown) that is substantially similar to the hooks 136 of bracket 59 described in more detail below. Rail 57 is secured to the uprights 54 utilizing a hook bracket 138, as described in more detail below.

Figure 12:
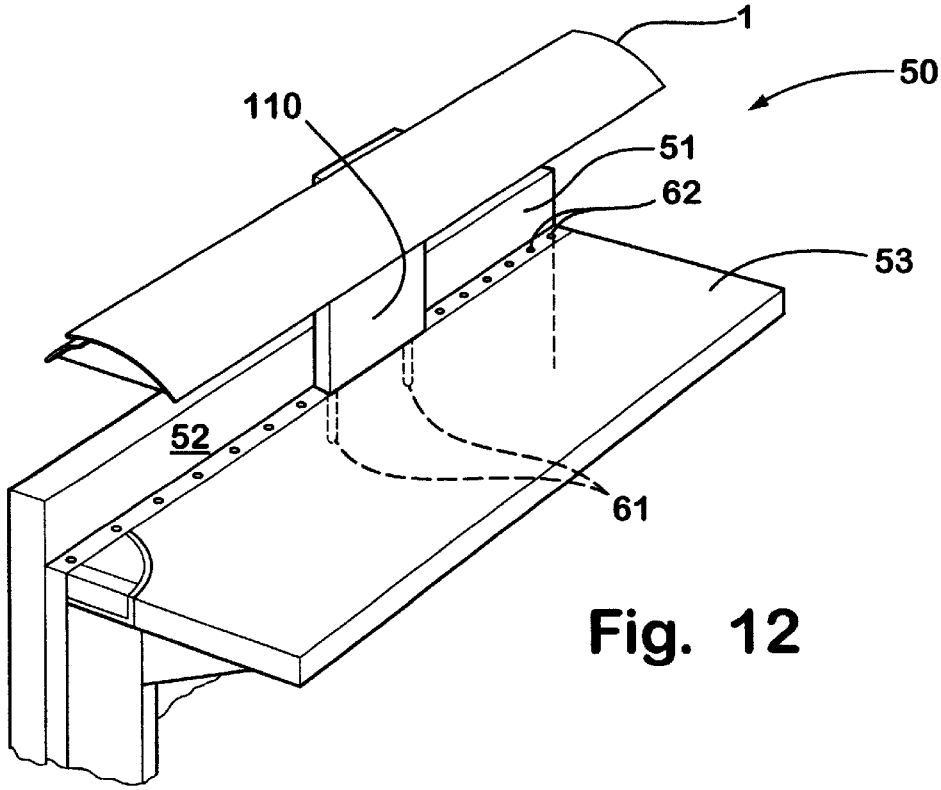
FIG. 12 is a partially schematic, fragmentary perspective view showing the tasklight mounted to a Steelcase CONTEXT® workstation.

Yet another arrangement is illustrated in FIG. 12. As described in more detail below, riser 110 includes at least one pin 61 extending from the lower end that is received within a selected one of a plurality of apertures 62 located along the rear edge of a standard Steelcase CONTEXT® workspace.

Figure 13:
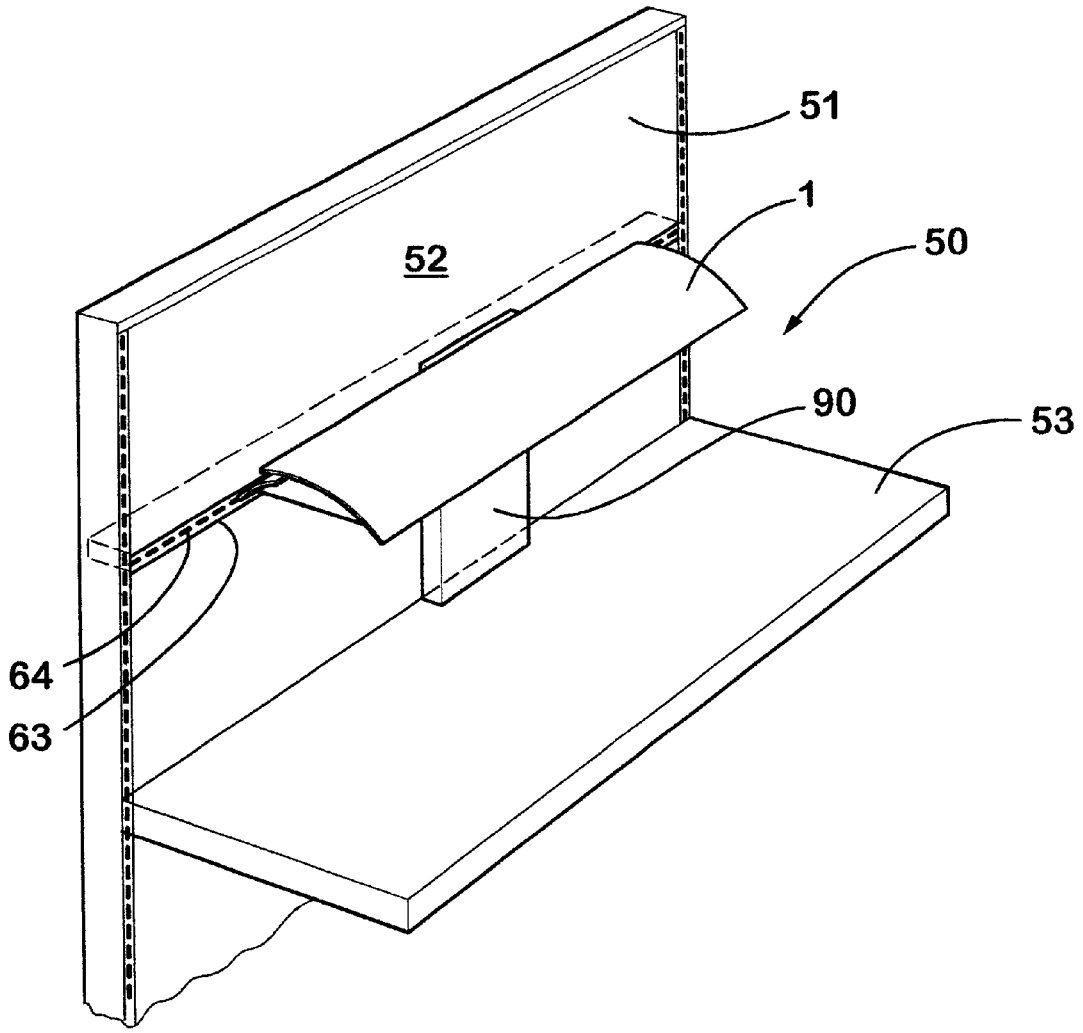
FIG. 13 is a partially schematic, fragmentary perspective view showing the tasklight mounted to a horizontal row of slots in a Steelcase PATHWAYS partition panel system.

As described in more detail below, the mounting arrangement of FIG. 13 includes a riser 90 and a bracket that interconnects the riser 60 to a horizontal frame member 63 having a plurality of apertures 64 forming a horizontal row of such apertures. The rear panel 51 illustrated in FIG. 13 is a standard Steelcase PATHWAYS partition panel, which may be either a two-inch or, four-inch panel, and may extend either partial-height or upwardly to the ceiling of the office space. An example of a partition panel system having a horizontal row of apertures can be found in commonly-assigned U.S. Pat. No. 5,839,240 to Elsholz et al., the entire contents of which are hereby incorporated herein by reference. Other examples of partitions having a horizontal row of apertures can be found U.S. Pat. No. 5,816,001 to Goodman et al.; U.S. Pat. No. 5,802,789 to Goodman et al.; U.S. Pat. No. 5,746,035 to Seiber et al.; U.S. Pat. No. 5,746,034 to Luchetti et al.; and U.S. Pat. No. 5,740,650 to Seiber et al.

Figure 14:
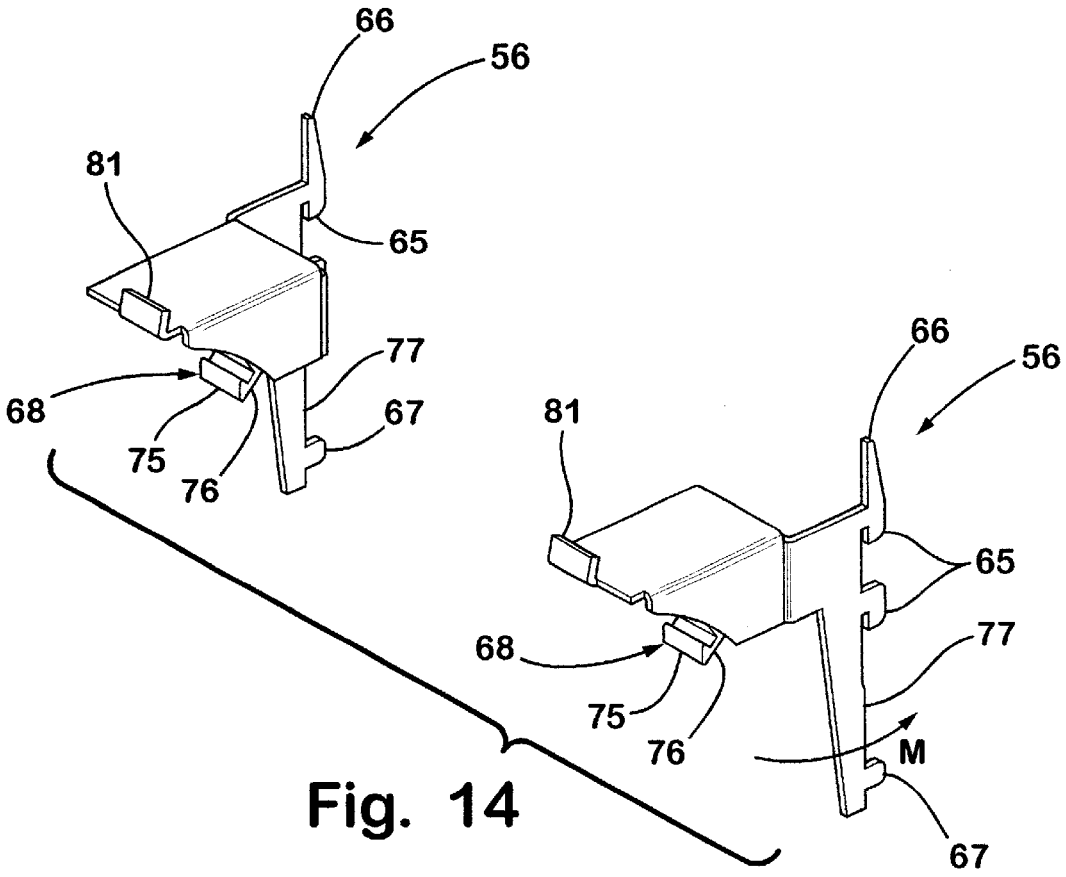
FIG. 14 is an exploded perspective view illustrating the brackets of FIG. 9.
Figure 15:
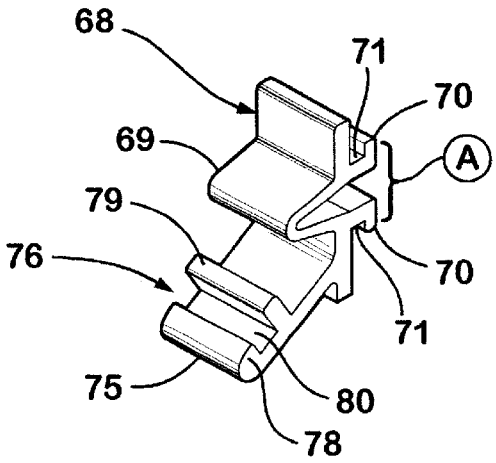
FIG. 15 is a perspective view of the resilient retainer of the brackets of FIG. 14.
Figure 16:
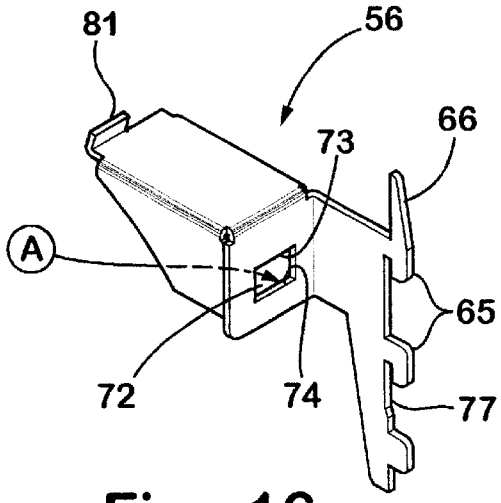
FIG. 16 is a perspective view of a hooked bracket with the resilient retainer of FIG. 15 removed.
Figure 17:
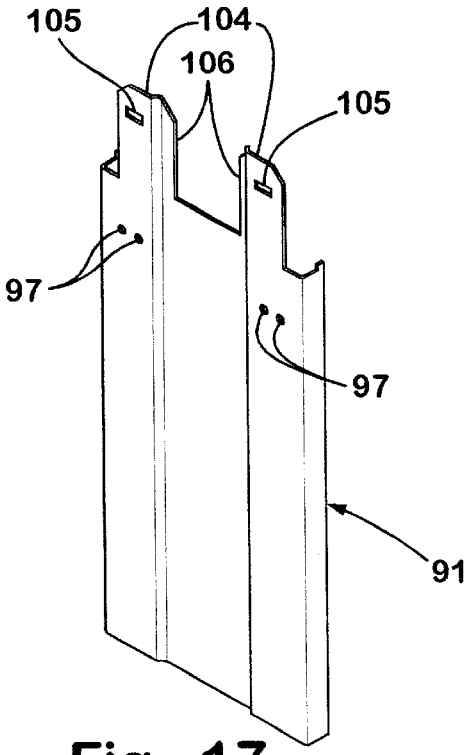
FIG. 17 is a perspective view of a riser frame used with the mounting configuration of FIG. 13.
Figure 18:
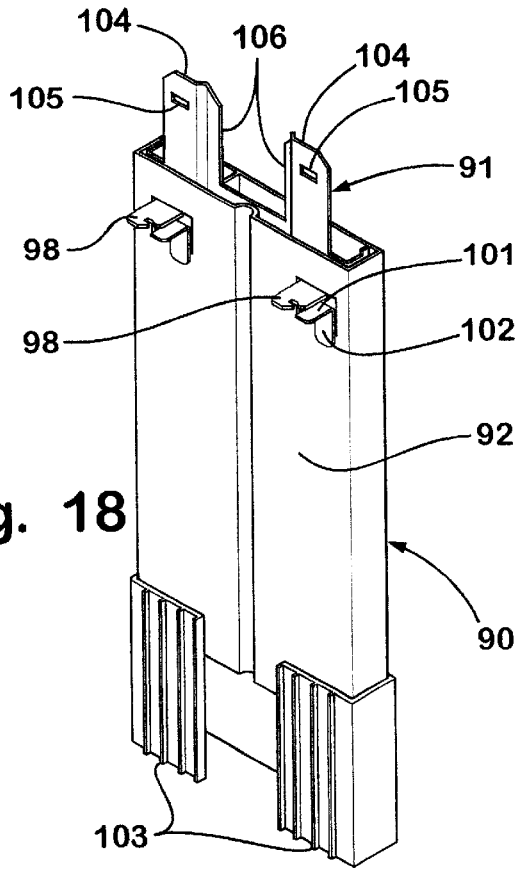
FIG. 18 is a perspective view of a riser assembly for a Steelcase PATHWAYS panel system as illustrated in FIG. 13.
Figure 19:
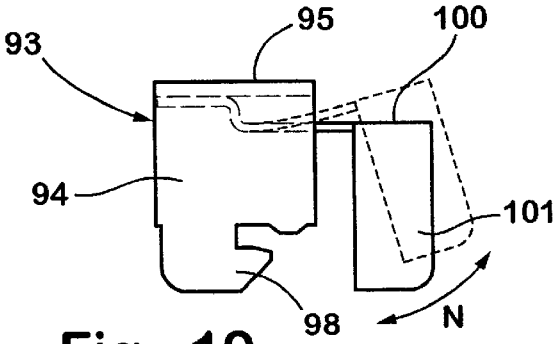
FIG. 19 is a top elevational view of the hooked bracket of FIG. 18.

With reference to FIG. 14, the brackets 56 of FIG. 9 each include at least one hook 65 that is received within the apertures 55 of the vertical panel frame member 54. The upper hook preferably includes a safety extension 66. During installation of the bracket 56 to the vertical frame member 54, the extension 66 is first inserted into the aperture 55, and the bracket 56 is then rotated downwardly in the direction of the arrow "M" until the intermediate hook 65 and tab 67 are received within apertures 55. The bracket 56 is then shifted downwardly to engage the hooks 65. With further reference to FIGS. 15 and 16, a resilient member 68 is formed of a flexible polymer material such as polyvinyl chloride ("PVC"), and includes a generally V-shaped portion 69 with terminal flanges 70 at the ends thereof defining grooves 71. During installation of the resilient member 68 to a bracket 56, the V-shaped portion 69 is flexed inwardly, and the terminal flange portions 70 are inserted through the opening 72 in bracket 56 (as shown by arrow "A", FIGS. 15, 16), such that the upper and lower edges 73 and 74 of opening 72 are received within the grooves 71. In the installed position, the end 75 of the lower resilient extension 76 extends downwardly and outwardly away from the rear edge 77 of the bracket 56. Resilient extension 76 includes a tapered barb portion 78 and a small transverse wall 79 that together define a groove 80. Each bracket 56 also includes an upper hook-like portion 81. The hooks 65 of brackets 56 can be configured to engage the slotted uprights of different types of partition systems. For example, a first type of bracket could be designed to engage with the slotted uprights of a standard Steelcase AVENIR® panel system, and a second type of bracket could be configured to engage the slotted uprights of a standard Steelcase SERIES 9000® panel system. Accordingly, the tasklight 1 can be quickly and easily mounted to a either a first or second type of panel system by choosing an appropriate first or second type of bracket corresponding to the partition system.

During installation, the brackets 56 are first installed to the apertures 55 of the vertical upright 54 of the panel 51. The tasklight 1 is then connected to the brackets 56 by moving the tasklight towards the brackets 56 such that the hook-like portion 81 is inserted into the open space 8 of housing 5 (see also FIG. 1), the hook-like portion 81 is engaged with the protrusion 82 of the first cover portion 2 of the housing 5. The tasklight 1 is then rotated downwardly, such that the rear edge 83 of the second cover portion 4 of the housing 5 engages the barbed end portion 78 of the resilient extension 76. As the tasklight 1 is rotated downwardly, the rear edge 83 causes flexation of the resilient extension, and then snaps into the groove 80, thereby retaining the tasklight 1 on the brackets 56. This arrangement permits the brackets 56 to be first installed to the rear panel 51, followed by insertion of the tasklight 1. Furthermore, because the brackets 56 can engage the tasklight 1 at a variety of locations along the protrusion 82 and rear edge 83, the brackets 56 can be spaced-apart at various distances depending upon the panel width, and the tasklight 1 can still be mounted thereto. Furthermore, the tasklight 1 can by shifted horizontally on the brackets 56 if desired for a particular application. To remove tasklight 1, resilient extensions 76 are manually flexed downwardly to disengage edge 83 from groove 80. The tasklight 1 is then rotated upwardly and disengaged from brackets 56.

Figure 20:
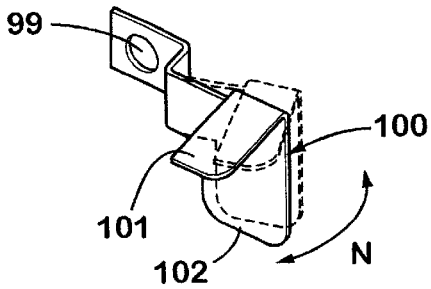
FIG. 20 is a perspective view of the retainer clip of FIG. 18.
Figure 21:
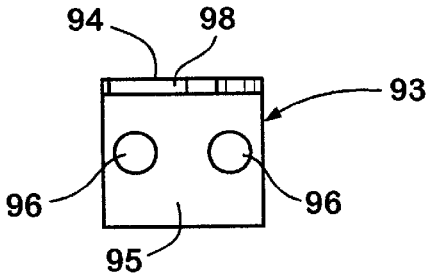
FIG. 21 is a front elevational view of the bracket of FIG. 19.
Figure 22:
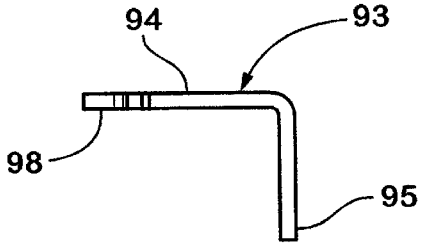
FIG. 22 is a side elevational view of the bracket of FIG. 19.

FIGS. 17–22 illustrate the various components of the riser of FIG. 13 used to connect the tasklight 1 to a standard Steelcase PATHWAYS partition panel 51. The PATHWAYS riser 90 includes a riser frame 91 (FIG. 17), and a polymer cover 92. A hooked bracket 93 has a generally L-shaped cross section with a horizontal leg 94 and a vertical leg 95 having a pair of apertures 96 therethrough. A pair of conventional fasteners extend through the apertures 96 of hooked bracket 93 and secure the hooked bracket to the apertures 97 of the riser frame 91. When the bracket 93 is installed to the riser frame 91, the hooks 98 are horizontally oriented, such that the hooks 98 may be received within the horizontal row of apertures 64 of the horizontal frame member 63 of a standard Steelcase PATHWAYS frame member. A locking clip 100 includes an aperture 99 that receives a fastener that passes through an aperture 96 in vertical leg 95 of bracket 93. Locking clip 100 includes a horizontal tab 101 with an adjacent vertical web 102. During installation of the tasklight 1 to the horizontal row of apertures 64, the vertical web portion 102 is manually grasped, flexing the tab 101 inwardly in the direction of the arrow "N" (FIG. 20). The horizontal hooks 98 are then inserted into apertures 64 and the riser 90 is shifted horizontally to engage hooks 98. The installer manually releases the vertical web 102, such that tab 101 springs back to its natural position into an aperture 64 directly adjacent to the aperture 64 occupied by the horizontal hook 98. The tab 101 thereby locks the riser 90 to the aperture 64 of the horizontal frame member 63. For removal of the riser 90, the web 102 is shifted to disengage horizontal tab 101 from the aperture, and the riser 90 is then shifted horizontally to disengage the hook 98 from the aperture 64. The cover 92 of the PATHWAYS riser 90 includes a series of ribs 103 that abut the rear panel 51 when in the PATHWAYS riser 90 is in the installed position to maintain the riser 90 in a vertical position. As described in more detail below, the riser frame 91 includes a pair of generally Z-shaped extensions 104 that are inserted into openings in the lower surface of the ballast/control box 32 to retain the tasklight 1 to the riser 90. As also described in more detail below, a pair of apertures 105 on the extensions 104 received resilient, barb members in the ballast/control box 32 to retain the tasklight 1 on the riser 90.

Figure 23:
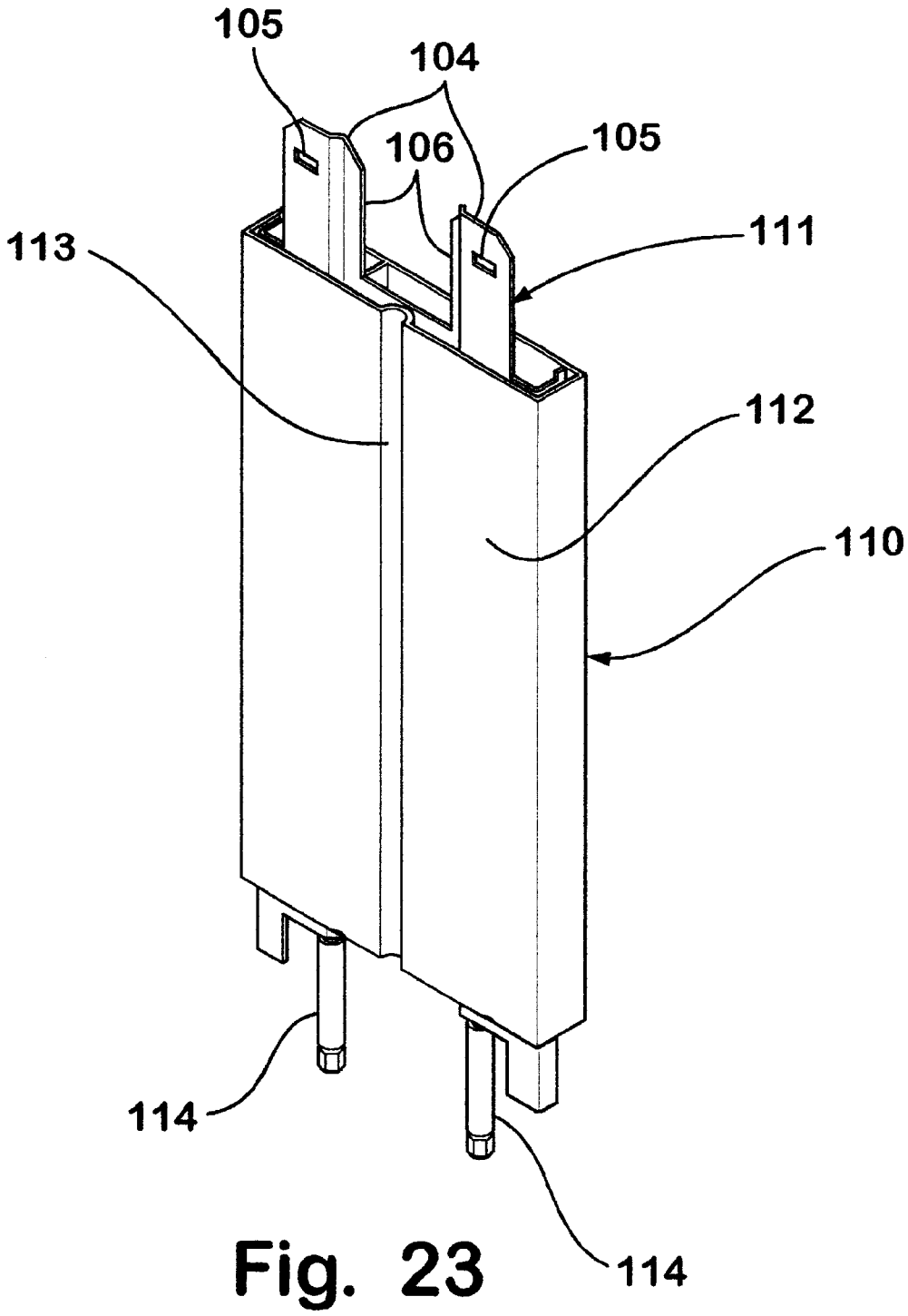
FIG. 23 is a perspective view of the riser assembly of FIG. 12.

With reference to FIG. 23, a riser assembly 110 (see also FIG. 12) includes a sheet metal riser frame 111 that is substantially similar to the riser frame 91 described above, and includes upward extensions 104 and apertures 105. A polymer cover 112 fits over the frame 111, and includes a channel 113 for vertical routing of wiring. A pair of pins 114 are welded or otherwise secured to the frame 111, and extend downwardly therefrom to engage the apertures 62 of a standard Steelcase CONTEXT® workspace. Additional detail and disclosure concerning the pins 14 and related connecting arrangement can be found in U.S. Pat. No. 5,486,042 to Heisler et al., issued Jan. 23, 1996 entitled "FURNITURE ARRANGEMENT", and U.S. Pat. No. 5,094,174 to Grund et al. issued Mar. 10, 1992 entitled "MODULAR FURNITURE", the entire contents of each of which are hereby incorporated by reference.

Figure 24:
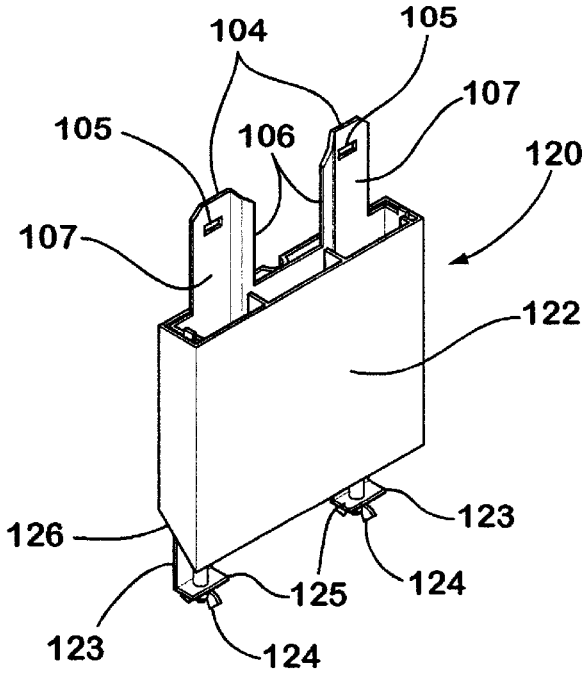
FIG. 24 is a perspective of a riser assembly used to connect the tasklight to a Steelcase WORKFLOW® rail.
Figure 25:
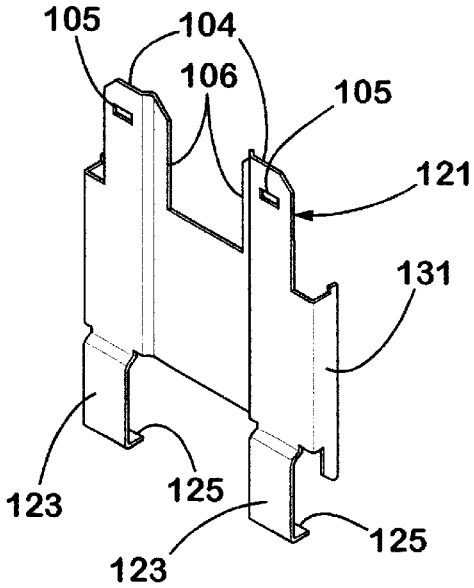
FIG. 25 is a perspective view of the riser frame of FIG. 24.
Figure 26:
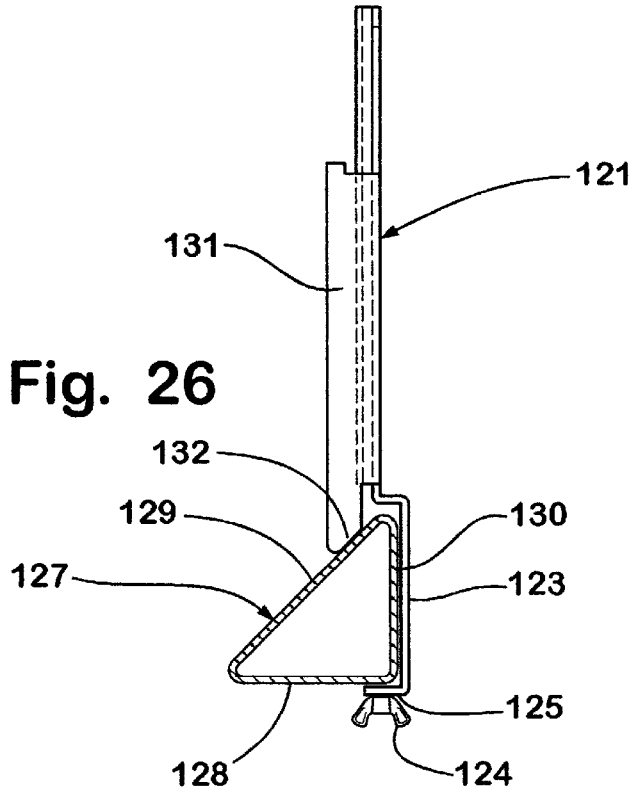
FIG. 26 is an end view showing the riser frame connected to a Steelcase WORKFLOW® rail.

With reference to FIGS. 24–26, another version of the riser 120 is configured to attach the tasklight 1 to a standard Steelcase WORKFLO® rail 127. Rail 127 is mounted to slotted uprights 54 utilizing standard hooked brackets (not shown). Riser 120 includes a polymer cover 122 and a frame 121. The metal frame 121 includes upward extensions 104 and apertures 105 that are substantially the same as described above with respect to riser frames 91 and 111. Frame 121 includes a pair of downward extensions 123, each of which includes a transverse lower flange 125 having a threaded opening therethrough that receives a thumb screw 124. The standard Steelcase WORKFLO® rail has a triangular cross-sectional shape with a generally horizontal lower side wall 128, and angled upper side wall 129, and vertical side wall 130. Riser frame 121 includes transversely extending sides 131 that terminate at an angled lower edge 132. The riser 120 is installed to the rail 127 by placing the riser frame 121 in a position wherein the angled lower edge 132 of sides 131 abut the angled side wall 129 of the rail 127. The thumb screw 124 is then tightened to secure the riser 120 to the rail 127.

Figure 27:
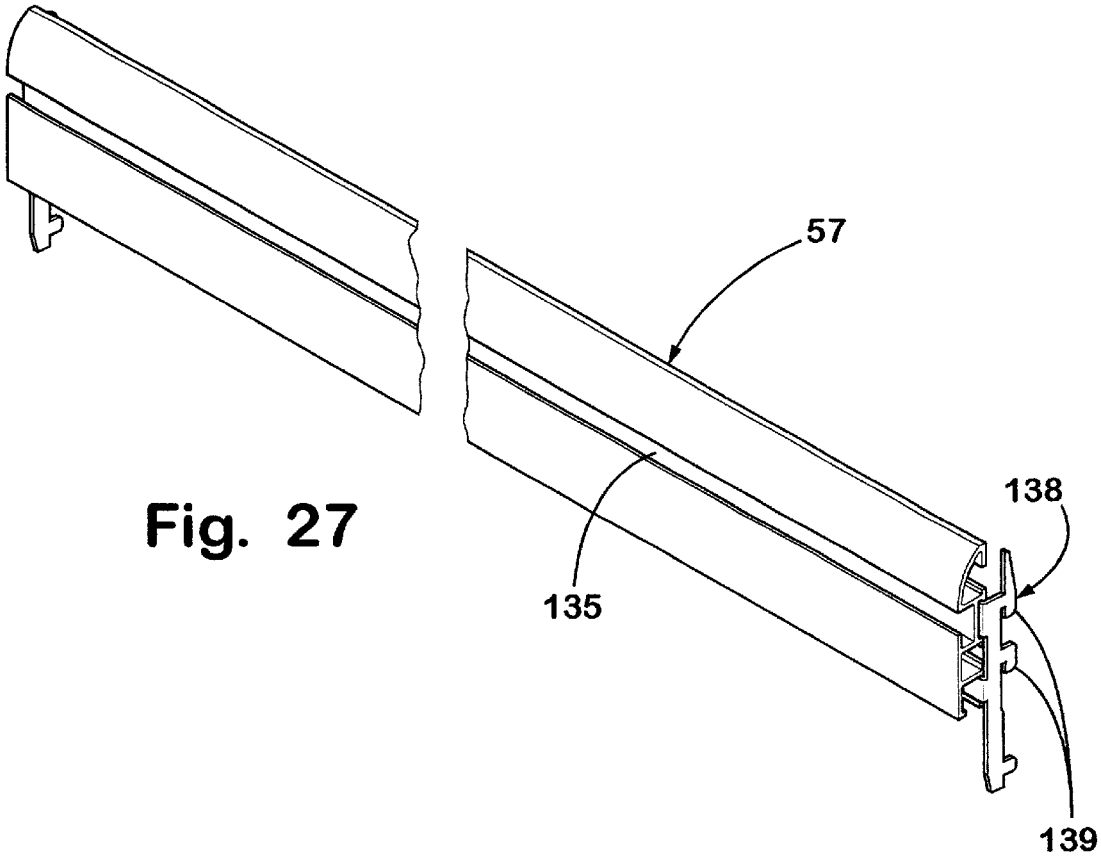
FIG. 27 is a fragmentary, perspective view of the rail of FIGS. 10 and 11.
Figure 28:
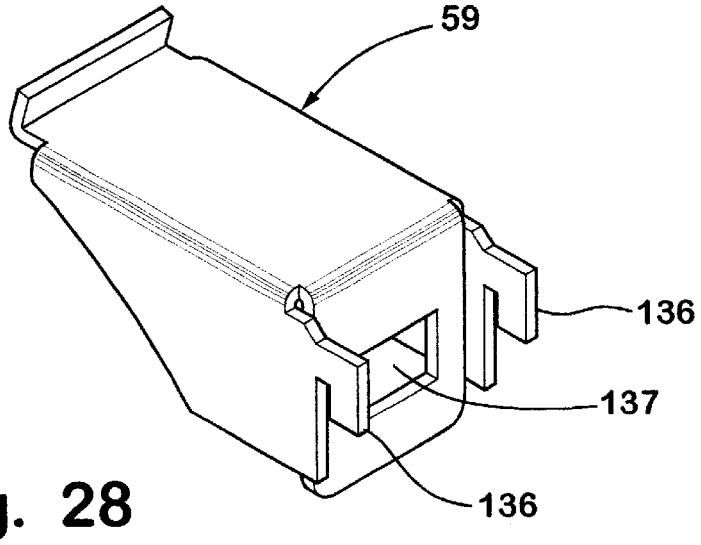
FIG. 28 is a perspective view of a bracket of FIG. 10.
Figure 29:
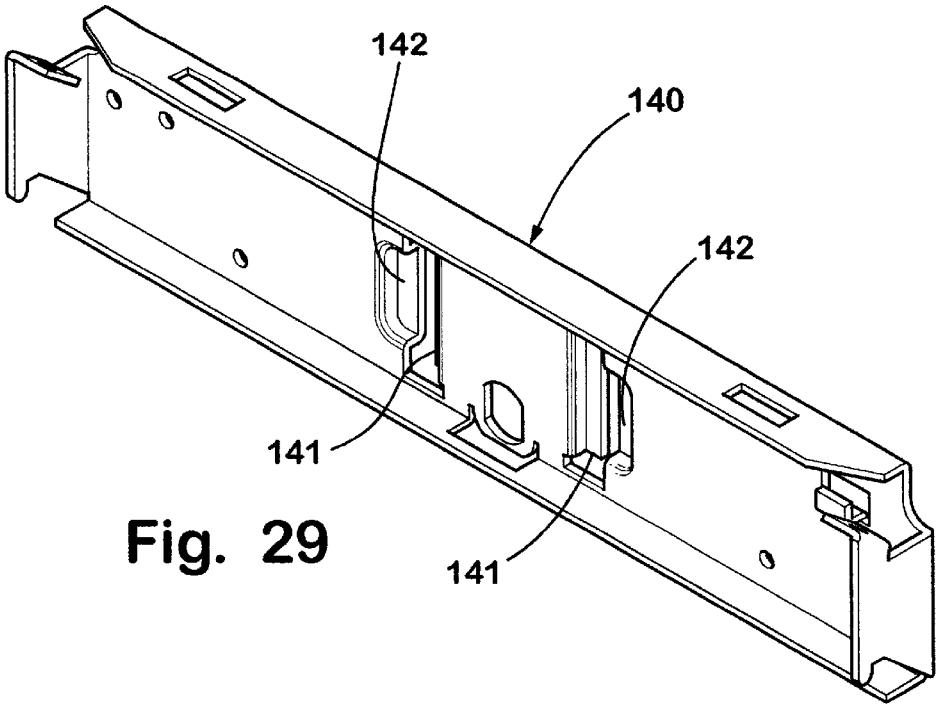
FIG. 29 is a perspective view of the tasklight frame.
Figure 30:
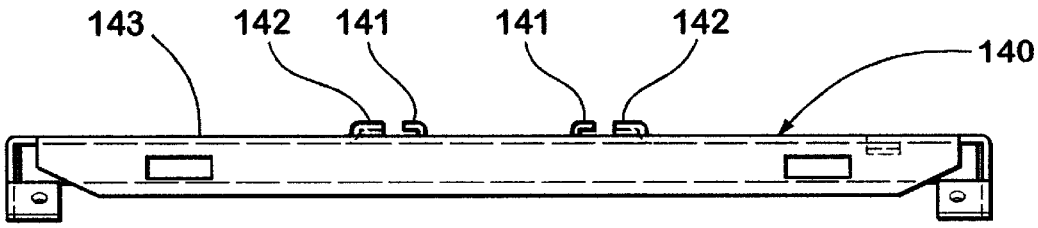
FIG. 30 is a top elevational view of the tasklight frame.
Figure 31:
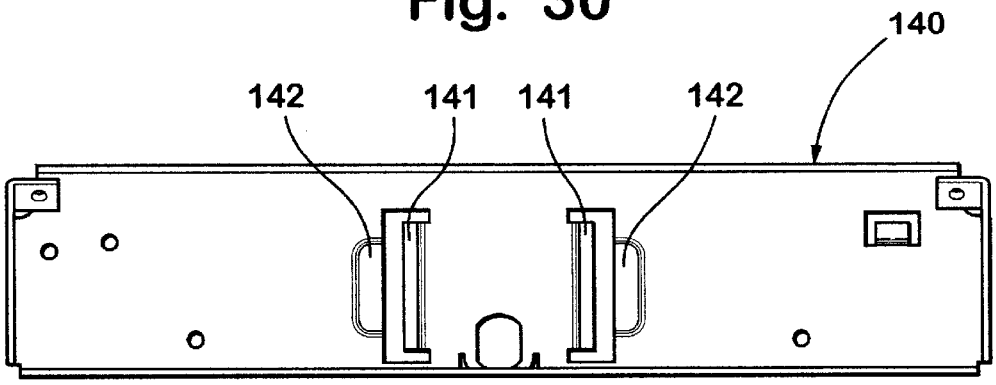
FIG. 31 is a front elevational view of the tasklight frame.
Figure 32:
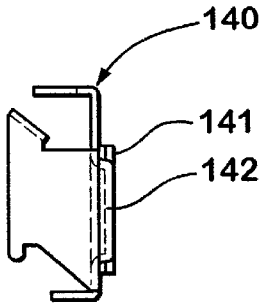
FIG. 32 is a side elevational view of the tasklight frame.

With reference to FIGS. 27 and 28, horizontal rail member 57 is an extruded aluminum member defining a channel 135. Bracket 59 includes a pair of hooks 136 that are removably received within the channel 135 to secure the channel 135. Bracket 59 includes an opening 137 that receives and retains a resilient member 68 in substantially the same manner as described above with respect to the brackets 56. A bracket 138 is secured to the rear side of the rail 57, includes at least a pair of hooks 139 that are received within the apertures 55 in the vertical upright 54 of the panel 51. The bracket 59 can slide horizontally along the channel 135, thereby permitting horizontal adjustment of the position of the tasklight 1.

With reference to FIGS. 29–32, a ballast bracket 140 is formed from sheet metal, and includes a pair of outwardly-opening spaced-apart flanges 141, and a pair of protrusions 142 adjacent the flanges 141. Ballast bracket 140 forms a portion of the internal structure of the ballast/control box 32, and interconnects with the various risers 90, 110, and 120 described above. The upward extensions 104 of each of the riser frames described above defame an inner side edge 106 that is slidably received between the flange 141 and rear wall 143 of the ballast bracket 140. Furthermore, the protrusions 142 formed by the sheet metal of the ballast bracket 140 contact the flange or the web portion 147 of extensions 104 of each of the riser frames described above to provide a snug interconnection between the riser and the ballast bracket 140.

Figure 33:
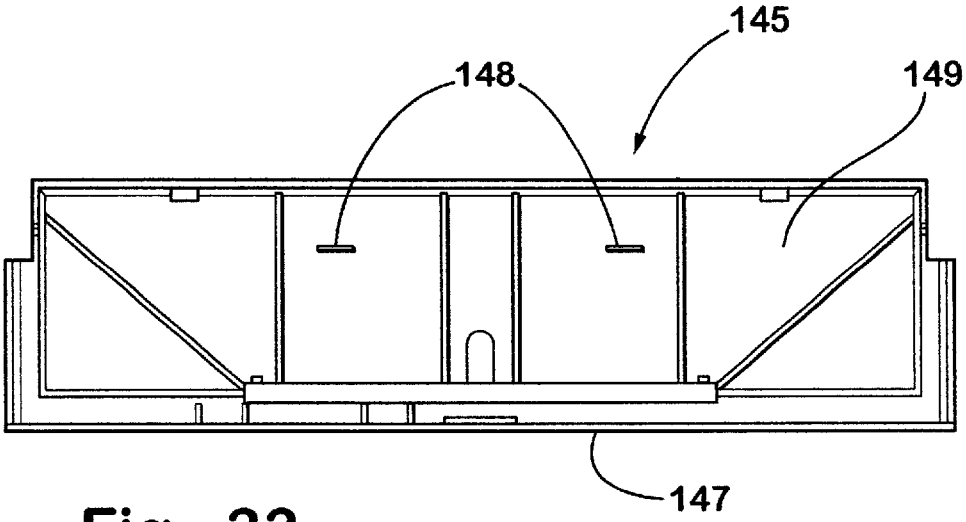
FIG. 33 is a front elevational view of the tasklight cover.
Figure 34:
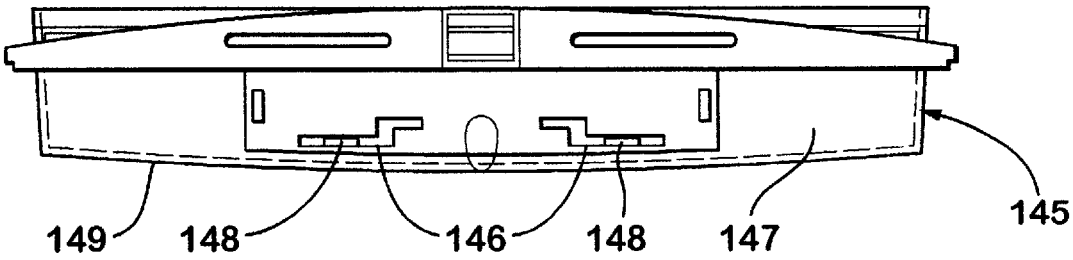
FIG. 34 is a bottom elevational view of the tasklight cover.
Figure 35:
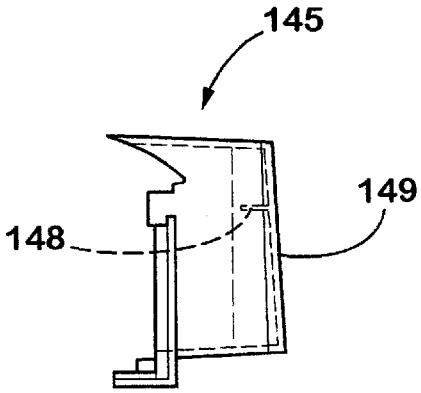
FIG. 35 is a side elevational view of the tasklight cover.

With further reference to FIGS. 33–35, a control box 145 is made of a polymer material, and includes a pair of generally Z-shaped openings 146 through a lower sidewall 147. The openings 146 receive the extensions 104 of the various riser frames described above during assembly, and the resilient extensions 148 protruding from the rear wall or web 149 are received within the apertures 105 of the upward extensions 104 of the various risers described above to secure the tasklight 1 to the riser. The combination of the sliding engagement of the extensions 104 in the flanges 141 of the ballast bracket 140 and the engagement of the resilient extensions 148 in the openings 105 retain the tasklight 1 to the riser.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A tasklight for illuminating a workspace having a horizontal worksurface and a vertical rear surface, said tasklight comprising:

a first elongated cover portion defining a first elongated side edge;

a second elongated cover portion connected to said first cover portion and defining therewith a housing having a lower side, said second elongated cover portion defining a second elongated side edge, said second side edge spaced-apart from said first side edge to define an open space through said housing between said first and second side edges extending along a rear side of said housing;

an elongated light source positioned proximate said lower side below said open space;

a reflective surface on said lower side of said housing having a shape configured to distribute light produced by said light source forwardly onto the worksurface; and said reflective surface forming a passageway with said open space of said housing and permitting beat produced by said light source to escape through said open space of said housing by convection, said passageway forming an opening on an upper side of said housing.

2. The tasklight of claim 1, wherein:

said reflective surface is formed on a discrete reflector member secured to said lower side of said housing.

3. The tasklight of claim 2, wherein:

said reflector member has at least one opening therethrough, said opening positioned proximate said open space through said housing to permit escape of heat therethrough.

4. The tasklight of claim 1, wherein:

said first and second cover portions have a concave shape and overlap one another at said open space;

said open space oriented rearwardly to distribute light on a vertical surface of the workspace.

5. The tasklight of claim 4, wherein:

said first and second cover portions have an arcuate cross-sectional shape that is substantially uniform along said cover portions.

6. The tasklight of claim 1, including:

an elongated refractor attached to said lower side of said housing and enveloping at least a portion of said light source;

said refractor having an open upper portion to permit escape of heat therefrom through said passageway.

7. The tasklight of claim 6, wherein:

said refractor has a U-shaped cross section.

8. The tasklight of claim 7, wherein:

said light source has an elongated tubular shape defining an outer surface;

said refractor defining an inner surface that is spaced-apart from said outer surface to thereby permit airflow around said light source and heat transfer from said light source.

9. The tasklight of claim 8, wherein:

said U-shaped cross section defines a pair of legs, each having at least one connector adjacent the end thereof for securing said refractor to said housing.

10. A tasklight for illuminating a workspace having a horizontal worksurface and a vertical rear surface, said tasklight comprising:

a first elongated cover portion defining a first elongated side edge;

a second elongated cover portion connected to said first cover portion and defining therewith a housing having a lower side, said second elongated cover portion defining a second elongated side edge, said second side edge spaced-apart from said first side edge to define an open space through said cover between said first and second side edges;

an elongated light source positioned proximate said lower side below said open space;

a reflective surface on said lower side of said housing having a shape configured to distribute light produced by said light source forwardly onto the worksurface; and said reflective surface forming a passageway with said open space of said housing said passageway forming a rearwardly facing opening and permitting light produced by said light source to escape rearwardly and upwardly onto the vertical rear surface through said open space of said housing.

11. The tasklight of claim 10, wherein:

said reflective surface is formed on a discrete reflector member secured to said lower side of said housing.

12. A tasklight for illuminating a workspace having a horizontal worksurface and a vertical rear surface, said tasklight comprising:

a first elongated cover portion defining a first elongated side edge;

a second elongated cover portion connected to said first cover portion and defining therewith a housing having a lower side. said second elongated cover portion defining a second elongated side edge, said second side edge spaced-apart from said first side edge to define an open space between said first and second side edges;

an elongated light source positioned proximate said lower side;

a reflective surface on said lower side of said housing having a shape configured to distribute light produced by said light source forwardly onto the worksurface;

said reflective surface forming a passageway with said open space of said housing, and permitting light produced by said light source to escape rearwardly onto the vertical rear surface through said open space of said housing;

said reflective surface is formed on a discrete reflector member secured to said lower side of said housing;

said reflector member has at least one opening therethrough, said opening positioned proximate said open space in said housing to permit escape of heat therethrough.

13. The tasklight of claim 10, wherein:

said first and second cover portions have a concave shape and overlap one another at said open space;

said open space oriented rearwardly to distribute light on a vertical surface of the workspace.

14. The tasklight of claim 13, wherein:

said first and second cover portions have an arcuate cross-sectional shape that is substantially uniform along said cover portions.

15. The tasklight of claim 10, including:

an elongated refractor attached to said lower side of said housing and enveloping at least a portion of said light source;

said refractor having an open upper portion to permit escape of heat therefrom through said passageway.

16. The tasklight of claim 15, wherein:

said refractor has a U-shaped cross section.

17. The tasklight of claim 16, wherein:

said light source has an elongated tubular shape defining an outer surface;

said refractor defining an inner surface that is spaced-apart from said outer surface to thereby permit airflow around said light source and heat transfer from said light source.

18. The tasklight of claim 17, wherein:

said U-shaped cross section defines a pair of legs, each having at least one connector adjacent the end thereof for securing said refractor to said housing.

19. The tasklight of claim 10, including:

an upright riser configured to support said tasklight above a worksurface in workspaces lacking overhead storage units.

20. A tasklight for illuminating a worksurface, comprising:

an elongated housing having a lower side and an opening therethrough;

an elongated tubular light source mounted below said opening through said housing;

an elongated refractor extending along said lower side of said housing and defining an upper side, said refractor enveloping at least a portion of said tubular light source and distributing light therefrom in a predetermined pattern; and said upper side of said refractor having an open portion forming a passageway with said opening through said elongated housing and permitting transfer of heat away from said tubular light source through said passageway.

21. The tasklight of claim 20, wherein:

said refractor is spaced-apart from said tubular light source, permitting air flow around said light source and transferring heat away from said light source.

22. The tasklight of claim 21, wherein:

said refractor has a U-shaped cross section.

23. The tasklight of claim 22, wherein:

said U-shaped cross section defines a pair of legs, each having at least one connector adjacent the end thereof that secures said refractor to said housing.

24. The tasklight of claim 23, wherein:

said housing includes connector openings; and said refractor includes at least one barbed portion at the end of each leg, said barbed portions received within said connector openings to secure said refractor to said housing.

25. The tasklight of claim 24, wherein:

said refractor is made of a polymer material having sufficient flexibility to permit flexing of said legs upon insertion of said barbed portion into said connector openings.

26. The tasklight of claim 20, wherein:

said housing has an opening therethrough adjacent said refractor to permit airflow through said housing to transfer heat from said tasklight.

27. The tasklight of claim 26, including:

a reflector secured to said housing that reflects light from the light source downwardly and forwardly onto a worksurface in a predetermined pattern.

28. The tasklight of claim 27, wherein:

said reflector has an opening therethrough adjacent said opening in said housing that transfers heat therethrough.

29. A tasklight for illuminating a worksurface, comprising:

an elongated housing having a lower side;

an elongated tubular light source mounted below said housing;

a reflector secured to said housing that reflects light from the light source downwardly and forwardly onto a worksurface in a predetermined pattern;

an elongated refractor extending along said lower side of said housing and defining an upper side, said refractor enveloping at least a portion of said tubular light source and distributing light therefrom in a predetermined pattern;

said upper side of said refractor having an open portion permitting transfer of beat away from said tubular light source;

said housing having an opening therethrough adjacent said refractor to permit airflow through said housing to transfer heat from said tasklight;

said reflector having an opening therethrough adjacent said opening in said housing that transfers heat therethrough; and said reflector having a mirrored parabolic surface portion extending forwardly from the light source, and a forwardly facing reflective surface rearward of the light source shaped to distribute light in predetermined manner and reduce glare on the worksurface.

30. A light arrangement comprising:

a housing defining a first side;

an elongated tubular light source defining an axis and an outer surface and extending along said first side in a spaced-apart relationship thereto; and an elongated refractor including a curved wall having a plurality of optical prisms extending perpendicular to said axis and distributing light axially along said tubular light source in a predetermined pattern to reduce glare on a worksurface, said refractor positioned around at least a portion of said light source said wall portion having a curved inner surface spaced-apart from said outer surface of said tubular light source to permit convective heat flow therefrom to facilitate cooling of said lighting arrangement.

31. The light arrangement of claim 30, wherein:

in said housing includes a reflector positioned on a lower side thereof.

32. The light arrangement of claim 31, wherein:

said refractor has an opening through said wall portion;

said housing has an opening forming a passageway with said opening in said refractor, said passageway permitting convective heat transfer therethrough.

33. The light arrangement of claim 32, wherein:

said refractor has a U-shaped cross section defining leg portions and an opening therebetween.

34. The light arrangement of claim 30, wherein:

said housing includes elongated upper and lower covers, each having curved cross-sectional shape;

said upper and lower covers overlapping one another to define an opening therebetween for escape of light.

35. A tasklight mountable to a slotted upright of a partition panel, said tasklight comprising:

an elongated housing including a light fixture adapted to support an elongated light source below said housing;

a bracket engaging said elongated housing for support thereof, said bracket including a portion adapted to secure said bracket to a slotted upright; and said bracket including a connector having a resilient extension releasably engagable with said housing at a selected one of a plurality of support positions along said elongated housing such that the positions of said elongated housing relative to said bracket can be adjusted, said connector retaining said elongated housing to said bracket and permitting installation of said bracket to slotted uprights of a partition panel.

36. A tasklight mountable to a vertical row of apertures of a partition panel, said tasklight comprising:

an elongated housing including a fixture for supporting a light source below said housing;

a pair of spaced apart brackets engaging said elongated housing for support thereof, said brackets including a portion adapted to be received in at least a selected one of a plurality of apertures forming a vertical row of apertures in a pair of spaced apart uprights to secure said brackets to the spaced apart uprights;

said brackets including a connector engagable with said housing in a manner permitting installation of said brackets to the uprights of a partition panel;

said brackets including a body and a resilient extension that flexes between engaged and disengaged positions relative to said body, said resilient extension being biased into said engaged position; and said elongated housing includes a portion shaped to engage said resilient extensions and interconnect said housing and said brackets at selected ones of a plurality of locations along said housing and permit adjustment of the spacing between said brackets for connecting to uprights that are spaced apart by different distances.

37. A tasklight mountable to a slotted upright of a partition panel, said tasklight comprising:

a housing including a fixture for supporting a light source below said housing;

a bracket engaging said elongated housing for support thereof, said bracket including a portion adapted to secure said bracket to a slotted upright;

said bracket including a connector engagable with said housing in a manner permitting installation of said bracket to slotted uprights of a partition panel, followed by connection of said housing to said bracket; and wherein:

said bracket includes a body and a resilient extension movable between engaged and disengaged positions relative to said body; and said housing includes a portion shaped to engage said resilient extension and interconnect said housing and said bracket; and wherein:

said housing defines first and second spaced-apart edges; and said bracket includes a hook portion that engages said first edge, said resilient extension engaging said second edge to interconnect said housing and said bracket when in said engaged position.

38. The tasklight of claim 37, including:

said bracket comprises a first bracket; and a second bracket substantially the same as said first bracket and spaced-apart therefrom to support said tasklight on a pair of spaced-apart slotted uprights.

39. A tasklight mountable to a slotted upright of a partition panel, said tasklight comprising:

a housing including a fixture for supporting a light source below said housing;

a bracket engaging said elongated housing for support thereof, said bracket including a portion adapted to secure said bracket to a slotted upright;

said bracket including a connector engagable with said housing in a manner permitting installation of said bracket to slotted uprights of a partition panel, followed by connection of said housing to said bracket; and wherein:

said bracket includes a body and a resilient extension movable between engaged and disengaged positions relative to said body;

said housing includes a portion shaped to engage said resilient extension and interconnect said housing and said bracket;

said housing defines first and second spaced-apart edges;

said bracket includes a hook portion that engages said first edge, said resilient extension engaging said second edge to interconnect said housing and said bracket when in said engaged position;

said bracket comprises a first bracket;

a second bracket substantially the same as said first bracket and spaced-apart therefrom to support said tasklight on a pair of spaced-apart slotted uprights;

each said bracket includes at least one hook configured to engage openings in a slotted upright for supporting said tasklight;

said housing includes an elongated cover having a curved cross-sectional shape that is substantially uniform along said elongated cover, said cover defining opposite first and second side edges; and said resilient member including a barbed end portion that engages said second side edge of said housing, said hook portion engaging said first side edge.

40. A combination tasklight and workspace having a vertical surface forming a rear perimeter of the workspace and a forwardly projecting horizontal worksurface, said tasklight comprising:

an elongated housing having a reflective surface on a lower side thereof and distributing reflected light from a light source onto said horizontal worksurface in a predetermined pattern downwardly and forwardly on said horizontal worksurface;

a lighting fixture attached to said housing that positions an elongated light source adjacent said housing in general alignment therewith;

a connector configured to securely interconnect said tasklight to a selected one of said worksurface and said vertical surface.

41. A reflector for tasklights shaped to distribute light from an elongated light source in a predetermined pattern on a worksurface, said reflector defining a mirror surface having a generally parabolic shape and extending forwardly from the elongated light source, and including a generally flat surface portion having a mirror finish and extending downwardly and forwardly from said parabolic surface, said flat portion having position that reduces the light intensity on a selected portion of the worksurface forward of said reflector.

42. A reflector for tasklights shaped to distribute light from an elongated light source in a predetermined pattern on a worksurface, said reflector defining a generally parabolic surface extending forwardly from the elongated light source, and including a generally flat portion extending downwardly and forwardly from said parabolic surface, said flat portion having position that reduces the light intensity on a selected portion of the worksurface forward of said reflector and said reflector including a second parabolic surface having the same focal point as said first parabolic surface, said second parabolic surface extending forwardly from said flat portion.

43. The reflector of claim 42, wherein:

said reflector includes a flat portion extending downwardly and rearwardly from a rear edge of said parabolic surface to diffuse light in a manner that reduces glare on said worksurface.

44. A combination partition panel and tasklight, comprising:

a partition panel defining spaced apart, generally vertical side faces and having a pair of upright frame members, each having a side face with a vertical row of apertures;

a tasklight having an elongated housing, an elongated shaped reflector, and an elongated light source below said elongated shaped reflector, said elongated shaped reflector having a concave reflective surface, the tasklight extending between said upright frame members;

first and second brackets engaging selected ones of said apertures and supporting said tasklight in an orientation wherein the light produced by the light source is directed downwardly parallel to said vertical side faces and outwardly away from said vertical side faces by said concave reflective surface, each of said first and second brackets having a resilient member that flexes between engaged and disengaged positions and securing said first and second brackets to said housing for support thereof when in said engaged position, and permitting removal of said housing when flexed into said disengaged position.

45. A method of attaching a tasklight to a partition, comprising:

providing a partition having a pair of spaced apart vertically extending frame members having a vertical row of openings therein, said partition including a horizontal worksurface;

providing a tasklight having an elongated light source and an elongated housing configured to direct light from said light source in a predetermined pattern, said tasklight defining an edge;

providing a pair of support brackets having resilient extensions having barbed connectors;

installing said brackets to said vertically extending frame members by engaging said vertical rows of openings;

installing said tasklight on said brackets by flexing said resilient extensions and engaging said edge with said barbed connectors.

46. A combination tasklight and workspace having a vertical surface defining a horizontally extending upper edge and forming a rear perimeter of the workspace, said workspace including a forwardly projecting horizontal worksurface, said workspace including a horizontal cross member positioned between said upper edge and said worksurface, said tasklight comprising:

an elongated housing having a reflective surface on a lower side thereof for distributing reflected light from a light source;

a lighting fixture attached to said housing that positions an elongated light source adjacent said housing in general alignment therewith;

a riser connected with said housing and extending downwardly therefrom, said riser connected to said cross member to support said housing above said cross member and said worksurface at a height facilitating illumination of tasks performed on said worksurface;

said riser including a connector configured to securely interconnect said tasklight to a selected one of said worksurface and said vertical surface;

said riser including a pair of horizontally oriented hooks configured to engage a horizontal row of slots in the vertical surface of the workspace.

47. The combination tasklight and workspace set forth in claim 46, wherein:

said elongated housing is positioned above said horizontally extending upper edge of said vertical surface.

48. A combination tasklight and workspace having a vertical surface defining a horizontally extending upper edge and forming a rear perimeter of the workspace, said workspace including a forwardly projecting horizontal worksurface, said tasklight comprising:

an elongated housing having a reflective surface on a lower side thereof for distributing reflected light from a light source;

a lighting fixture attached to said housing that positions an elongated light source adjacent said housing in general alignment therewith;

a riser connected with said housing and extending downwardly therefrom to support said housing above said worksurface at a height facilitating illumination of tasks performed on said worksurface;

an elongated rail extending horizontally along a rear portion of said workspace, said rail defining an elongated channel; and a portion of said riser received within said channel and supporting said tasklight in a position above said horizontally extending upper edge of said vertical surface.

* * * * *

UNITED STATES PATENT AND TRADEMARK OFFICE

CERTIFICATE OF CORRECTION

PATENT NO. : 6,386,723 B1 
DATED : May 14, 2002
INVENTOR(S) : David C. Eberlein et al.

It is certified that error appears in the above-identified patent and that said Letters Patent is hereby corrected as shown below:

Column 2,
Line 51, "tie" should be -- the --;

Column 9,
Line 45, "defame" should be -- define --;

Column 10,
Line 27, "beat" should be -- heat --;

Column 13,
Line 24, "beat" should be -- heat --;
Line 55, before "said" delete "in".

Signed and Sealed this

Third Day of September, 2002

*Attest:*

*Attesting Officer*

JAMES E. ROGAN
*Director of the United States Patent and Trademark Office*